United States Patent [19]

Matsui et al.

[11] Patent Number: 4,581,779

[45] Date of Patent: Apr. 15, 1986

[54] SANITARY WASHING APPARATUS

[75] Inventors: Hiroyuki Matsui, Osaka; Kazuaki Fujita, Nara; Manabu Seno; Yoshitaka Morikawa, both of Yamatokoriyama, all of Japan

[73] Assignee: Matsushita Electric Industrial Co. Ltd., Osaka, Japan

[21] Appl. No.: 629,535

[22] PCT Filed: Nov. 2, 1983

[86] PCT No.: PCT/JP83/00393

§ 371 Date: Jul. 6, 1984

§ 102(e) Date: Jul. 6, 1984

[87] PCT Pub. No.: WO84/01973

PCT Pub. Date: May 24, 1984

[30] Foreign Application Priority Data

Nov. 9, 1982 [JP] Japan ..... 57-169517[U]
Jan. 31, 1983 [JP] Japan ..... 58-14883
Jan. 31, 1983 [JP] Japan ..... 58-14885

[51] Int. Cl.[4] ..... A47K 3/20

[52] U.S. Cl. ..... 4/420.2; 4/420.1; 4/420.4; 4/448

[58] Field of Search ..... 4/420.1–420.5, 4/443–448; 137/625.47

[56] References Cited

U.S. PATENT DOCUMENTS

| | | | |
|---|---|---|---|
| 1,183,544 | 5/1916 | Dittrich | 137/625.47 |
| 1,887,679 | 11/1932 | Guidetti et al. | 4/420.2 |
| 2,104,210 | 1/1938 | Salvoni | 4/420.3 |
| 2,854,027 | 9/1958 | Kaiser et al. | 137/625.47 |
| 3,430,268 | 3/1969 | Zoberg | 4/420.1 |
| 4,123,807 | 11/1978 | Oguma et al. | 4/448 |
| 4,208,746 | 6/1980 | Minamoto et al. | 4/420.2 |
| 4,237,560 | 12/1980 | Riegelman et al. | 4/420.2 |
| 4,242,764 | 1/1981 | Fukuda | 4/420.4 |

FOREIGN PATENT DOCUMENTS

| | | |
|---|---|---|
| 49-18924 | 5/1974 | Japan . |
| 55-95739 | 7/1980 | Japan . |
| 55-126630 | 9/1980 | Japan . |
| 55-126631 | 9/1980 | Japan . |
| 56-68082 | 6/1981 | Japan . |
| 56-105588 | 8/1981 | Japan . |
| 57-61190 | 12/1982 | Japan . |

*Primary Examiner*—Stephen Marcus
*Assistant Examiner*—Linda J. Sholl
*Attorney, Agent, or Firm*—Spencer & Frank

[57] ABSTRACT

A washing apparatus body mounted on a toilet bowl is provided with a hot-water tank supplied with water by a feed water supply device, such as a pump, a function changeover valve connected to the hot-water tank, a plurality of nozzles connected to the function changeover valve, at least a part of the nozzles being provided within the washing apparatus body, and a vacuum releasing valve positioned in the water path between the hot-water tank and the function changeover valve for discharging water in the water path downstream therefrom after use of the apparatus so that no water remains in the downstream water path in a standby state. Hot-water paths leading from the hot-water tank to the nozzles are made as short as possible so as to permit hot water from the hot-water tank to jet out from the respective nozzles toward a user in a short period of time upon the starting of washing and to minimize heat losses in the lines. Accordingly, the user experiences only washing water of a comfortable temperature, even when use is initiated.

10 Claims, 17 Drawing Figures

SANITARY WASHING APPARATUS

TECHNICAL FIELD

The present invention relates to a sanitary washing apparatus used for washing the private parts of the human body with comfortably warm water, for example.

BACKGROUND ART

In recent years, sanitary washing apparatus combined with Western style toilet bowls have become widespread. One type of these sanitary washing apparatus employs a single washing nozzle which is used both as a device for washing the anus and as a bidet. However, this type of apparatus are surpassed in function by sanitary washing apparatus which are provided both with a nozzle that is exclusively used for washing the anus and with a bidet nozzle, since the lather apparatus makes it possible to obtain the proper positions and angles for jetting out washing water. Such sanitary washing apparatus having both types of nozzle are disadvantageous however in that the water passage for passing warm water is incoveniently long.

FIGS. 1 and 2 in combination show a conventional sanitary washing apparatus, which is composed of a toilet bowl 1, a toilet seat 2, an anus washing nozzle 3 and a bidet nozzle 4 which are disposed on the toilet seat 2, and a washing apparatus body 5 which is installed on the floor and accommodates therein a hot-water tank, a pressurizing pump, a controller, etc. The anus washing nozzle 3 and the bidet nozzle 4 are supplied with the hot water in the hot-water tank through connecting hoses 3', 4' which respectively provide communication between the washing apparatus body 5 and the nozzles 3, 4. Further, the washing apparatus body 5 is provided with a hot-water temperature adjusting knob 6, a hot-water quantity adjusting knob 7 and a function changeover knob 8.

FIGS. 3, 4 in combination show another conventional sanitary washing apparatus, which includes a toilet bowl 9 provided with an anus washing nozzle 10 and a bidet nozzle 11 which are supplied with hot water through respective connecting hoses 10', 11' from a washing apparatus body 13 which is installed on the floor and accommodates therein a hot-water tank, a pressurizing pump, a controller, etc. In addition, this sanitary washing apparatus is provided with a toilet seat 12, a power switch 14, a hot-water temperature adjusting knob 15, a hot-water quantity adjusting knob 16 and a function changeover knob 17, similarly to the apparatus shown in FIGS. 1, 2.

Both the above-described conventional sanitary washing apparatus have inconveniently long water passages, respectively extending from the hot-water tanks accommodated in the washing apparatus bodies 5, 13 to the anus washing nozzles 3, 10 and the bidet nozzles 4, 11; therefore, the hot water discharged from the hot-water tanks by a washing operation takes a long time to reach the end of each nozzle. More specifically, since the washing water remaining in the connecting hoses 3', 4'; 10', 11' during the suspension of operation has cooled down to become warm water of relatively low temperature, this rather cold water must be jetted out and removed before the hot water is discharged from each of the nozzles 3, 4; 10, 11. It is extremely unpleasant for a person to be sprayed with a jet of cold water, even for a short time, prior to jetting out of hot water by a washing operation, particularly when the room temperature is low in the winter.

According to the arrangement of each of the above-described sanitary washing apparatus, the user sits on the toilet seat 2, 12 and after bowel movement actuates the function changeover knob 8, 17 to wash the anal part with the anus washing nozzle 3, 10. In the case of a woman in her menstrual period, she washes the female genital parts with the bidet nozzle 4, 11. Particularly in the case of a woman, it is common practice to wash the genital parts with the bidet nozzle after washing the anus even in the case of defecation and to wash the anus after washing the genitalia when she is in her menstrual period. In other words, it is frequent practice for women to use both nozzles, one after the other.

The conventional sanitary washing apparatus, however, are extremely disadvantageous in use when the anus is washed and the genitalia are subsequently washed, since the bidet nozzle 4, 11 has cooled down to such an extent that the water therein reaches a very low temperature, which results in the fact that, after the anus has been washed with hot water of a comfortable temperature (about 40° C.), the hot water is suddenly changed over to the cold water for washing the genital parts. In a toilet where the room temperature is below 5° C. in the winter, the cold water becomes so low in temperature that the user almost jumps with the chill of the cold water. The female parts to be washed are especially sensitive; therefore, the sensation caused by such cold water makes women feel very uncomfortable. Although the bidet nozzle 4, 11 has a function which is extremely appreciated by women, it cannot be practically used unless the above-described disadvantage is overcome. The same is the case with washing the anus after the genital parts.

Further, in the conventional sanitary washing apparatus, the connecting hose connected to either the anus washing nozzle or the bidet nozzle is exceedingly long, since the nozzles are disposed on both sides of the toilet bowl 1, 9, and the washing apparatus body 5, 13 accommodating the hot-water tank is disposed on one of the sides of the toilet bowl 1, 9. In the above-described apparatus, the connecting hose 4', 11' connected to the bidet nozzle 4, 11 is undesirably long. Since the connecting hose 4', 11' is so long, the hot water is cooled down even during use, and the water remaining in the connecting hose 4', 11' when the apparatus is in an inoperative state is correspondingly large in quantity, which aggravates the problem that the user is chilled by the cooled water at the beginning of washing. In addition, the temperature of the hot water during use is lower as the room temperature becomes lower. The temperature of the hot water also changes according to the season and differs according to the hours in a day, that is, there is a large difference in temperature between the morning and evening and the daytime, which causes inconvenience to the user. Furthermore, since the connecting hoses 3', 4'; 10', 11' are different in length, there is a difference in time from when the function changeover knob 8, 17 is actuated until the hot water is jetted out from the anus washing nozzle 3, 10 and the bidet nozzle 4, 11. In other words, since the connecting hose 4', 11' connected to the bidet nozzle 4, 11 is longer than those connected to the anus washing nozzle 3, 10, the bidet nozzle 4, 11 involves a longer response time than the anus washing nozzle 3, 10, which is inconvenient when alternately using the anus washing nozzle and the bidet nozzle.

These disadvantages would be overcome by positioning the hot-water tank in the center of the area between both the nozzles in order to allow the lengths of the connecting hoses 3', 4'; 10', 11' to be equalized and reduced. It is, however, difficult from the dimensional point of view to provide the hot-water tank in the center of the area between both the nozzles while permitting the toilet seat 2, 12 to have sufficiently large dimensions and ensuring a hot-water quantity that will satisfy the user. For this reason, the hot-water tank is inevitably placed closer to either of the sides of the toilet bowl 1, 9. Accordingly, the above-described disadvantages are unavoidable in the case where the nozzles are positioned on both sides of the toilet bowl 1, 9.

Further, in the conventional sanitary washing apparatus, the nozzles are provided inside the toilet bowl 1, 9 and therefore are unfavorably exposed to filth and filthy water.

DISCLOSURE OF INVENTION

In view of the above-described disadvantages of the prior art, it is a first object of the present invention to prevent cold water from being jetted out from both the anus washing and bidet nozzles by arranging them such that the water path from the hot-water tank to each nozzle is greatly reduced, and to allow either or both of the anus washing nozzle and the bidet nozzle to be selectively changed over with ease at any time.

It is a second object of the present invention to provide a sanitary washing apparatus with a plurality of nozzles improved to prevent the user from being made to feel unpleasant by being touched by a jet of cold water from a cold nozzle in which hot water has been undesirably cooled down when one of the nozzles has been used and another nozzle is subsequently used, and to allow the user to wash comfortably without feeling any change in temperature.

It is a third object of the present invention to prevent cold water from jetting out from a nozzle when a user changes over to it following use of another by means of a function changeover valve.

To attain the first object, according to the invention, a hot-water tank and a function changeover valve are provided in a washing apparatus body mounted on a toilet bowl, and at least a part of a plurality of nozzles connected to the function changeover valve are provided in the washing apparatus body to reduce the water path from the hot-water tank to each nozzle, thereby permitting the hot water coming out of the hot-water tank when washing commences to jet out from each nozzle, and to reduce the quantity of water remaining in each nozzle after the washing operation, thereby preventing any cold water from jetting out at the time of starting a subsequent washing operation. Further, either or both of an anus washing nozzle and a bidet nozzle can be selectively used at any time by the actuation of the function changeover valve.

To attain the second object, according to the present invention, a plurality of nozzles are positioned closer to each other to transfer heat from the nozzle being used to the other nozzles to thus retain the warmth thereof, thereby preventing the hot water from cooling down even when the nozzles are changed over from one to another.

Further, to attain the third object, according to the present invention, the arrangement is such that when one nozzle is selected by means of the function changeover valve, a subsidiary water path is formed for the other nozzle to allow the nozzle which is not being used to be supplied with hot water at such a flow rate that it will not jet out of the nozzle.

One embodiment of the present invention will be described in the following with reference to the accompanying drawings.

BEST MODE FOR CARRYING OUT THE INVENTION

Figure 1:
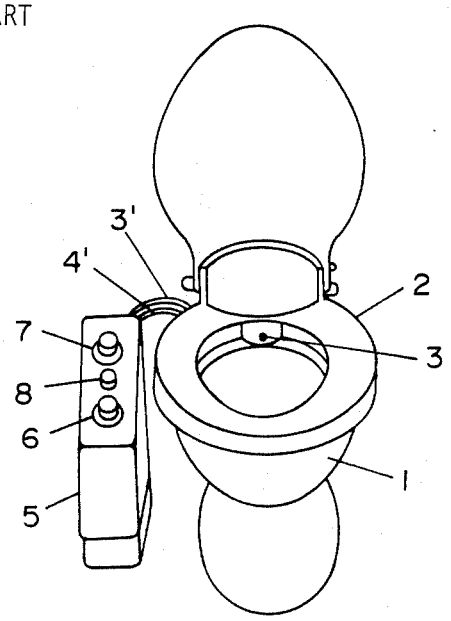
Fig. 1 PRIOR ART
FIG. 1 is a perspective view of a conventional sanitary washing apparatus according to the prior art.
Figure 2:
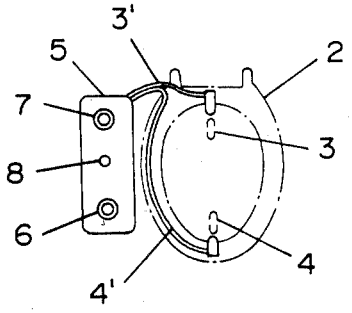
Fig. 2 PRIOR ART
FIG. 2 is a fragmentary plan view of the sanitary washing apparatus shown in FIG. 1.
Figure 3:
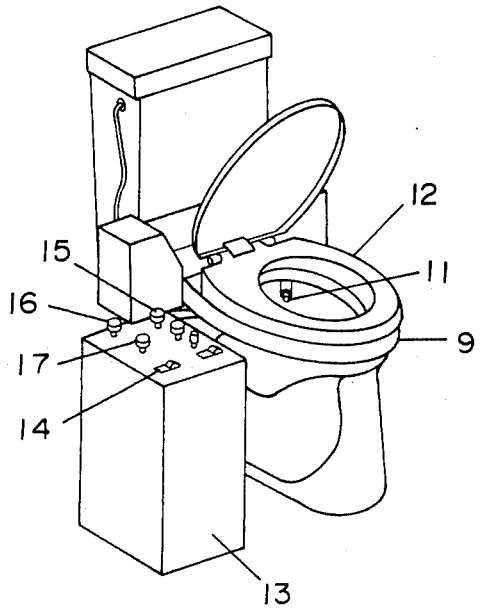
Fig. 3 PRIOR ART
FIG. 3 is a perspective view of another conventional sanitary washing apparatus according to the prior art.
Figure 4:
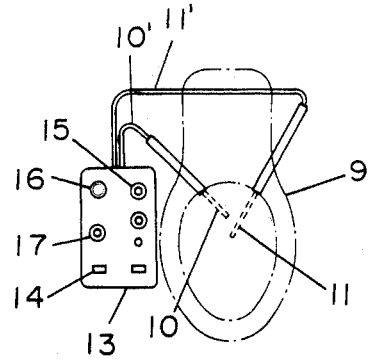
Fig. 4 PRIOR ART
FIG. 4 is a fragmentary plan view of the sanitary washing apparatus shown in FIG. 3.
Figure 5:
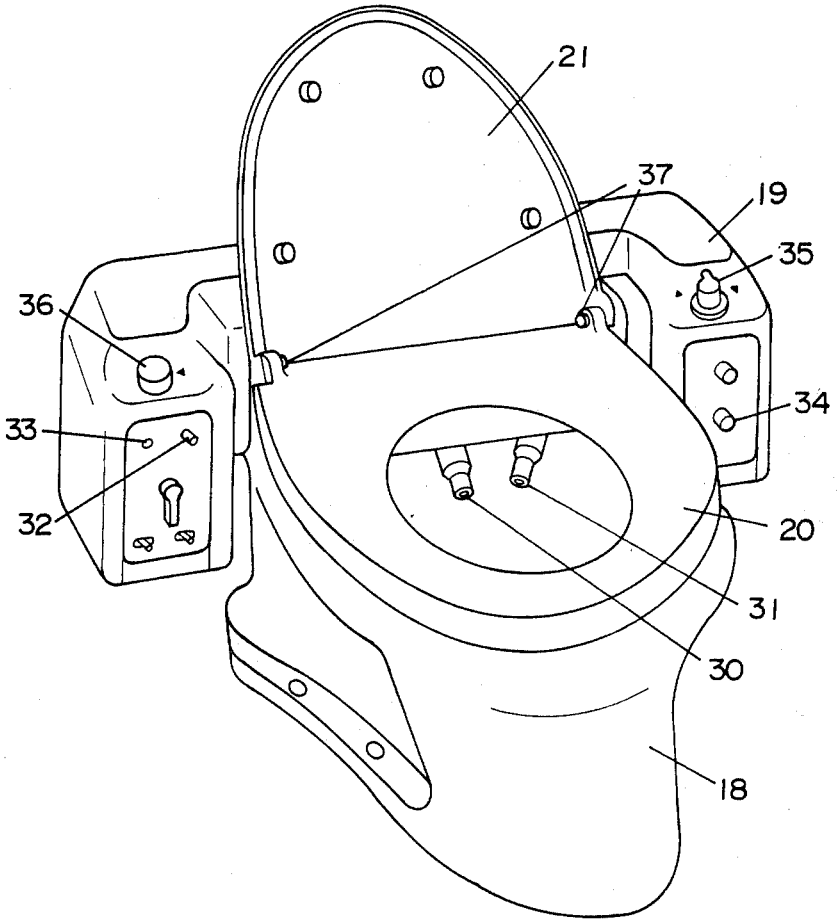
FIG. 5 is a perspective view of a sanitary washing apparatus in accordance with one embodiment of the present invention.
Figure 6:
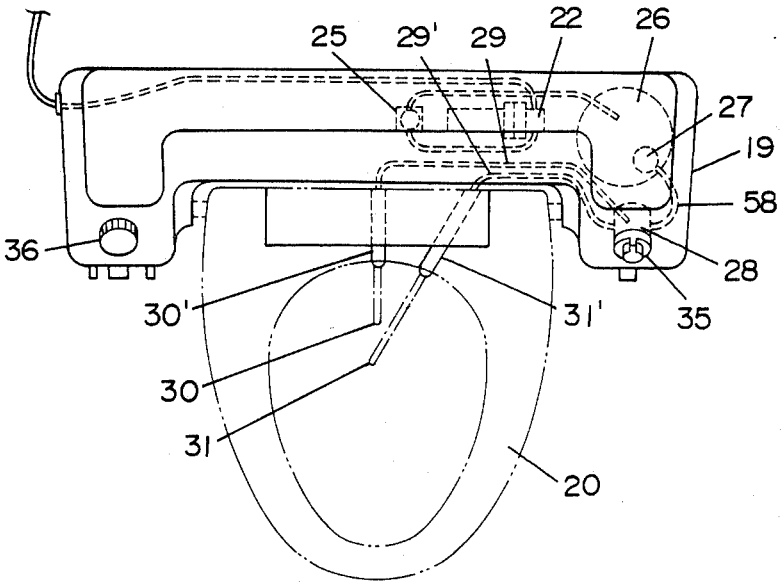
FIG. 6 is a plan view of a washing apparatus body of the sanitary washing apparatus shown in FIG. 5.
Figure 7:
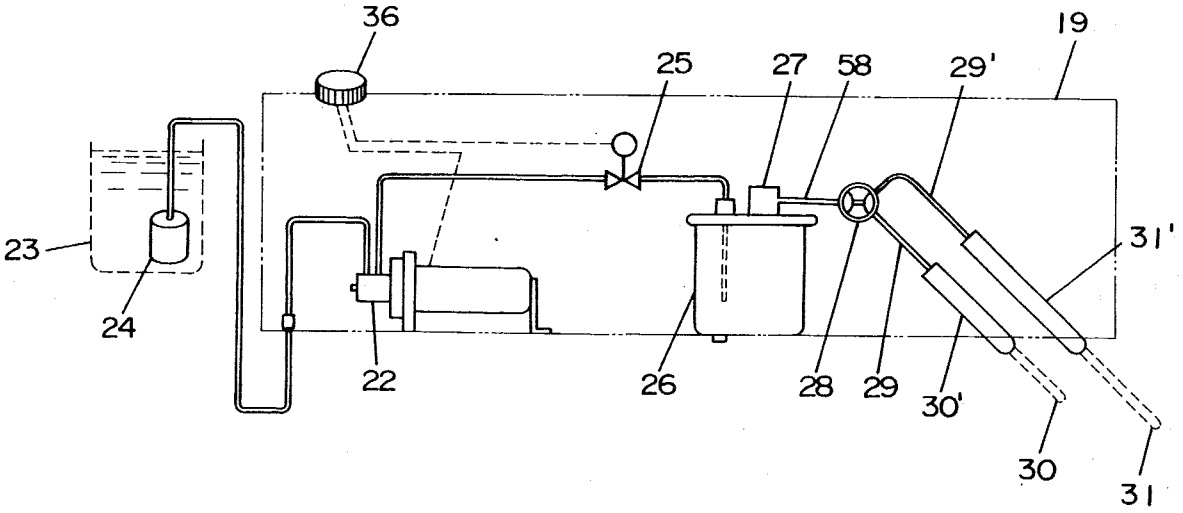
FIG. 7 is a diagram of a washing water circuit in the sanitary washing apparatus shown in FIG. 5.

Referring first to FIGS. 5 to 7, a washing apparatus body 19 is mounted on the rear part of a toilet bowl 18, which is provided thereon with a toilet seat 20 and a toilet seat cover 21. The cover 21 is adapted to be opened and closed as desired with the aid of pivot pins 37.

The washing apparatus body 19 is provided therein with a pump 22 for pressurizing washing water as a feed water means. The pump 22 is adapted to suck in the water contained in an external water tank (e.g., cistern) 23 through a filter 24 and to deliver the water into a hot-water tank 26 provided in the washing apparatus body 19 through a solenoid valve 25 also provided in the washing apparatus body 19. The hot-water tank 26 is constituted by a hermetically sealed container provided with a heating means (not shown). The hot-water tank 26 is communicated with an anus washing nozzle 30 and a bidet nozzle 31 through a vacuum releasing valve 27 provided on the upper part of the hot-water tank 26, a function changeover valve 28 and respective connecting hoses 29, 29'. It is to be noted that the nozzles 30, 31 are respectively housed in nozzle casings 30', 31'. The washing apparatus body 19 is also provided therein with a pump controller, a hot-water temperature controller and other control means. Further, the washing apparatus body 19 is provided with a power switch 32, a pilot lamp 33, a hot-water temperature adjusting knob 34, a function changeover knob 35 and an operating knob 36.

In the above-described arrangement, first, the power switch 32 is turned ON, whereby the pilot lamp 33 is lit.

Next, the hot-water temperature adjusting knob 34 is turned to set the dial reading to a desired temperature. In the case of setting it at 40° C., for example, the water contained in the hot-water tank 26 is heated to the set temperature within two to three minutes and is maintained at the fixed temperature by means of the hot-water temperature controller.

When the function changeover knob 35 is turned to select any one of the three modes, i.e., the anus washing nozzle, the bidet nozzle or both in combination, the gate of the function changeover valve 28 is opened to a specified position.

Then, the operating knob 36 is turned. Thereupon, the solenoid valve 25 is opened, and the pump 22 is energized. If the turning angle of the operating knob 36 is increased, the number of revolutions of the pump 22 is increased to cause the deliver pressure to vary from 0 to 1.2 $Kg/cm^2$. The operation of the pump 22 causes the water, sucked in from the water tank 23 through the filter 24, to pass through the solenoid valve 25 and to push up the hot water contained in the hot-water tank 26. Consequently, the hot water pushed up flows through the function changeover valve 28 to reach the selected nozzle 30 or 31. Both the nozzles 30, 31 are hydraulically movable and therefore are caused to slide out of the respective nozzle casings 30', 31' by hydraulic pressure and are received in the nozzle casings 30', 31' by releasing the hydraulic pressure. Accordingly, the selected nozzle 30 or 31 is caused to slide out of the nozzle casing 30' or 31' by hydraulic pressure and jets out hot water at a predetermined position with a predetermined angle, thereby attaining the purpose of washing the genital parts of the human body.

When the operating knob 36 is turned to return it to the position 0, the solenoid valve 25 is closed to stop the pump 22, so that the water pressure in the hot-water tank 26 lowers to open the vacuum releasing valve 27. Accordingly, while the washing water in the water path extending from the vacuum releasing valve 27 to each of the nozzles 30, 31 is flowing out, the nozzles 30, 31 are received in the respective nozzle casings 30', 31' to complete the washing operation and stand by for a subsequent washing operation. At this time, since the solenoid valve 25 is closed, there is no possibility that the water may undesirably flow out as a result of siphonage, even under conditions of installation wherein the level of water in the water tank 23 is higher than the vacuum releasing valve 27.

In a standby state, the washing water in the water path downstream from the vacuum releasing valve 27 to each of the nozzles 30, 31 has been discharged, i.e., has flowed out completely and will not remain therein as cold water. The hot water forced out of the hot-water tank 26 when washing commences has its heat absorbed by the tube walls defining the water path leading to each of the nozzles 30, 31, resulting in a reduction in temperature of the hot water jetted out of the nozzles 30, 31 at the beginning of washing. Since the water path in this embodiment is extremely short, however, there is only a small effect of heat absorption by the tube walls. In other words, cold water will never be jetted out of the nozzles 30, 31 when washing commences. In addition, the hot water has only a small reduction in temperature at the beginning of washing, and any lowered temperature quickly recovers to a fixed temperature.

It is to be noted that the function changeover knob 35 may be actuated while the washing water is jetting out. For example, during the selected use of the anus washing nozzle 30, the function changeover knob 35 can be actuated to changeover from the anus washing nozzle 30 to the bidet nozzle 31, or to the use of both in combination, thereby to continue the washing.

It is to be noted that although the vacuum releasing valve 27 is employed in the above-described embodiment, it is, needless to say, possible to attain the ends of the present invention without employing the vacuum releasing valve 27, since the water path leading to each of the nozzles 30, 31 is designed so as to be extremely short.

As described above, according to the invention, the vacuum releasing valve 27 is positioned at the highest position of the water path extending from the hot-water tank 26 to each of the nozzles 30, 31, and the water path can be reduced in length. Therefore, the water retained in the water path after the washing operation stops easily flows out therefrom and will not remain therein as cold water. Accordingly, there is no possibility that the user may be made to feel uncomfortable by being contacted by a jet of cold water when washing commences. In addition, there is only a small reduction in temperature of hot water at the beginning of washing, and any lowered temperature quickly recovers to a fixed temperature.

Any one of the three modes, i.e., the anus washing nozzle, the bidet nozzle or both in combination can easily be selected by the actuation of the function changeover knob 35. Moreover, this selection can successively be effected when hot water is jetting out of one nozzle. For example, the bidet nozzle can be used subsequently to the use of the anus washing nozzle. Thus, the modes can be changed over from one to another as desired at any time.

Figure 8:
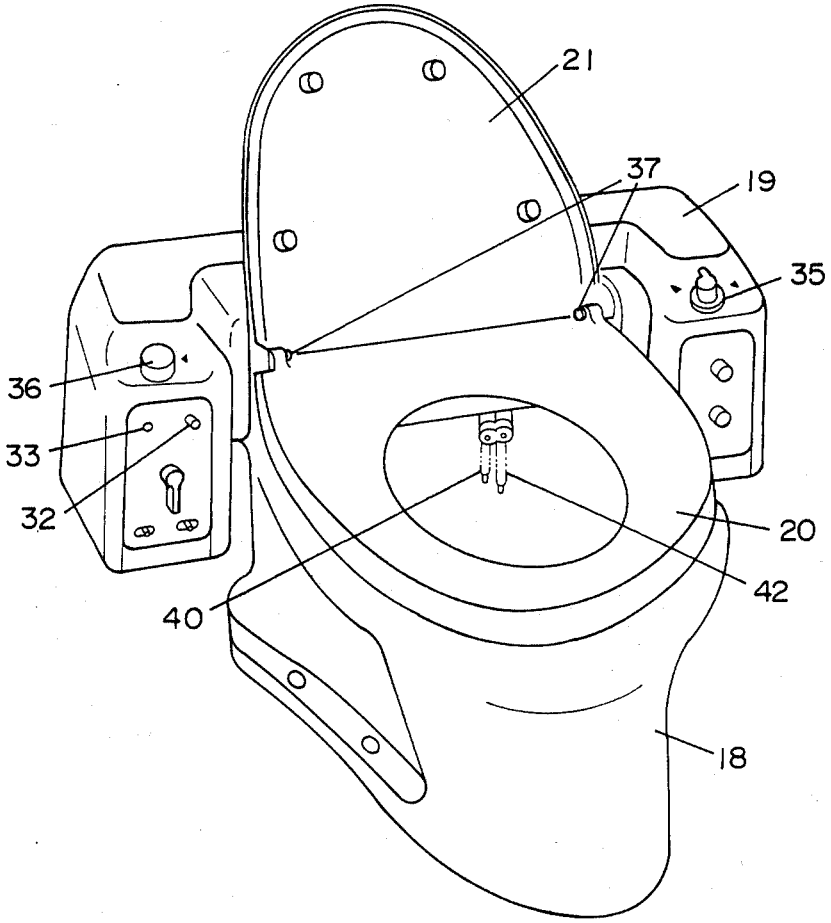
FIG. 8 is a perspective view of a sanitary washing apparatus in accordance with another embodiment of the present invention.
Figure 9:
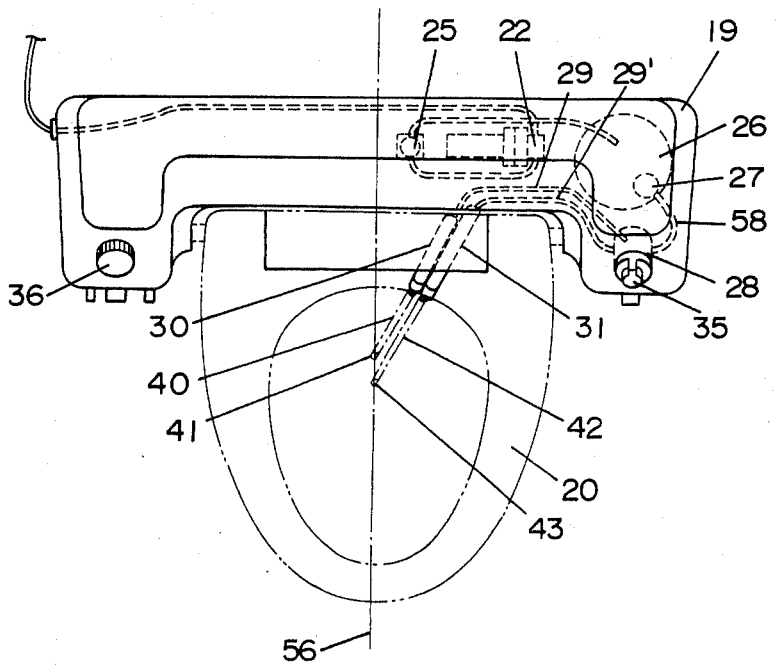
FIG. 9 is a plan view of the sanitary washing apparatus shown in FIG. 8.
Figure 10:
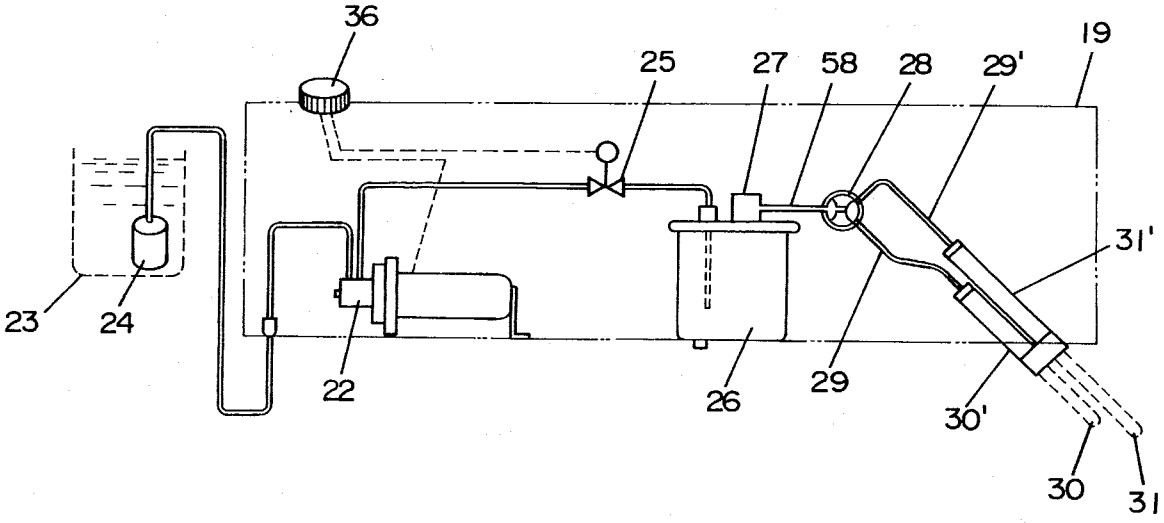
FIG. 10 is a diagram of a washing water circuit in the sanitary washing apparatus shown in FIG. 8.

Another embodiment of the present invention will now be described with reference to the accompanying drawings. In FIGS. 8 to 10, the same parts as those in FIGS. 5 to 7 are denoted by the same reference numerals as those in FIGS. 5 to 7, and only parts which are different from those in the first-described embodiment will be explained.

Figure 11:
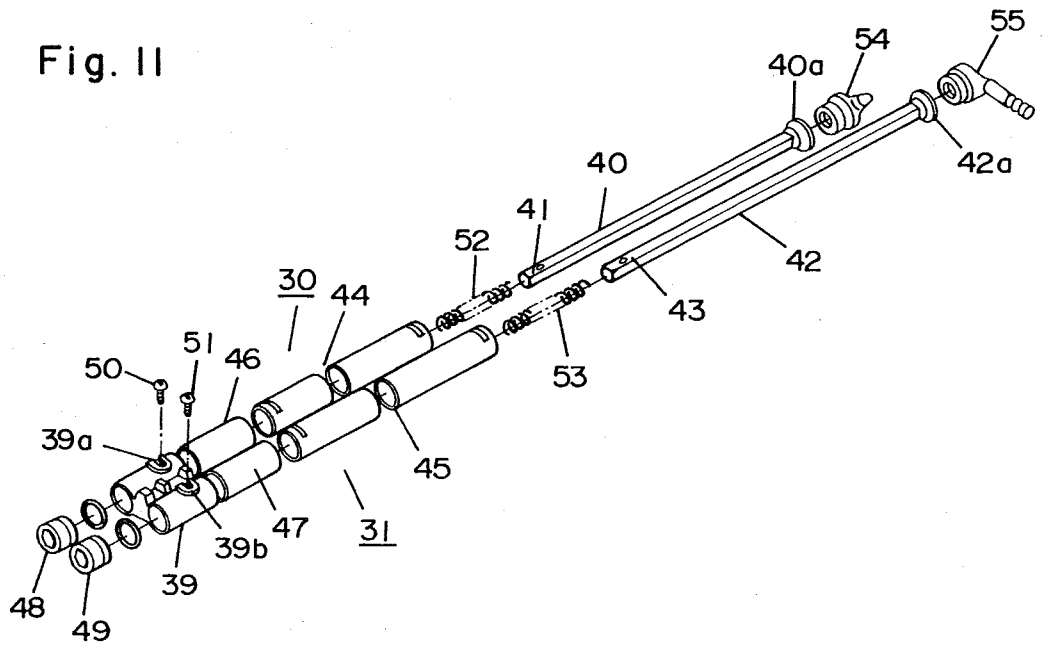
FIG. 11 is an exploded perspective view of washing nozzles in the sanitary washing apparatus shown in FIG. 8.
Figure 12:
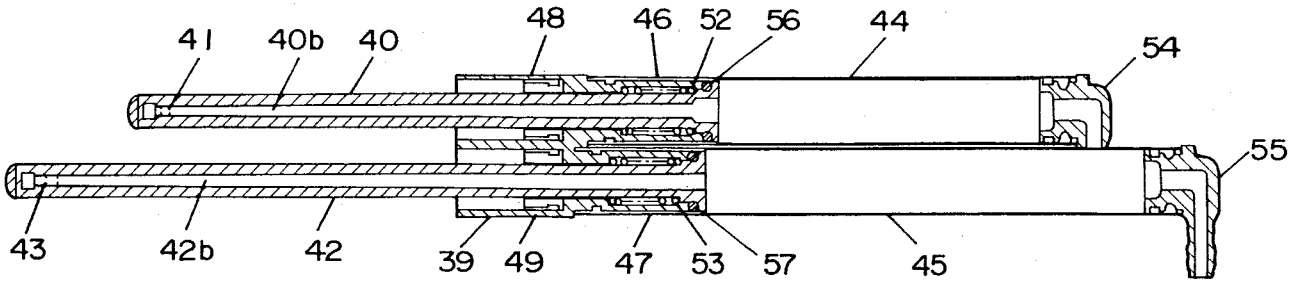
FIG. 12 is a sectional view of the washing nozzles shown in FIG. 11 in an operative state (although either—but not both—of the nozzles projects when used, both of them are projecting in the Figure for the sake of explanation)
Figure 13:
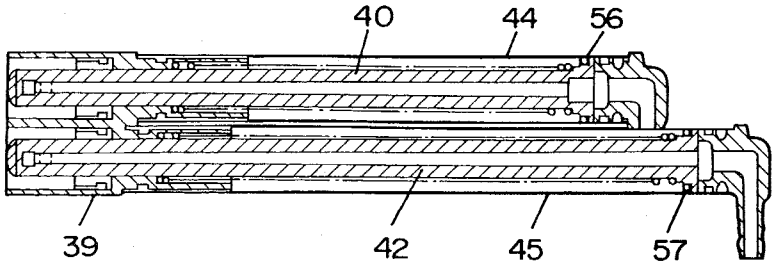
FIG. 13 is a sectional view of the washing nozzles in an inoperative state.

An anus washing nozzle 30 and a bidet nozzle 31 are integrated with each other by a guide portion 39 as shown in FIG. 11 which is an exploded view. The nozzle having a shorter length surves as an anus washing nozzle, and the nozzle having a longer length surves as a bidet nozzle. Both the nozzles are provided in parallel to each other. FIGS. 12 and 13 are sectional views taken along a plane passing through the central axes of both the nozzles. The Figures show a nozzle body 40 having at the distal end thereof a nozzle opening 41 for washing the anus and a nozzle body 42 having at its distal end thereof a nozzle opening 43 for washing the female genitalia. Both the nozzle bodies 40, 42 have a hexagonal prism-like outer shape except for their head portions 40*a*, 42*a* and are respectively provided therein with water supply passages 40*b*, 42*b*. Cylinders 44, 45 made of a metallic material are respectively received in cylindrical portions 46, 47 of the guide portion 39 and are provided close and parallel to each other, so that heat is allowed to transfer from one to the other. Rotation limiters 48, 49 have a hexagonal inner shape which is slightly larger than the hexagonal outer shape of the nozzle bodies 40, 42, and are respectively secured into holes in the guide portion 39 by means of screws 50, 51 thereby to restrict the rotation of the nozzle bodies 40, 42. Screw-receiving holes 39*a*, 39*b* in the guide portion 39 are respectively constituted by slots to permit the fixed rotation limiters 48, 49 to move within the slots in the direction of rotation, thereby allowing adjustment of the angles for jetting out washing water. Springs 52, 53 respectively urge the nozzle bodies 40, 42 in the direction for receiving the same into the cylinders 44, 45. Further, the cylinders 44, 45 are respectively provided with water inlets 54, 55 for introducing hot water into the cylinders 44, 45. The nozzles 30, 31 move toward the toilet bowl 18 when supplied with hot water from the water inlet 54, 55, and respectively seal the gaps between the nozzle bodies 40, 42 and the guide portion 39 when packings 56', 57 provided at the head portions of the nozzle bodies 40, 42 respectively abut against the cylindrical portions 46, 47 of the guide portion 39. At the same, the projecting motions of the nozzle bodies 40, 42 stop, and hot water is jetted out from the nozzle openings 41, 43 toward the anal and genital parts of the human body thereabove. FIG. 12 shows this state. For the sake of explanation, however, the Figure shows the state where both the anus washing nozzle and the bidet nozzle are projecting. In the case of the sanitary washing apparatus of the invention, the user selects either of the nozzles for use by actuating the function changeover knob 35. FIG. 13 shows the state where the washing nozzles are not supplied with hot water.

The nozzle unit constituted by the anus washing nozzle and the bidet nozzle integrated with each other has at least a part thereof housed within the washing apparatus body 19 as shown in FIG. 9 and is placed diagonally i.e., at an acute angle with respect to the central axis 56 of the toilet bowl 18 and the sanitary washing apparatus such that the water inlets 54, 55 are closer to the hot-water tank 26 and the central axes of both nozzles 30, 31 are directed diagonally downward. The anus washing nozzle 30 is positioned closer to the central axis 56 than the bidet nozzle 31. Both the nozzles are positioned at the same height i.e., located in substantially the same horizontal plane and disposed adjacent each other. When the nozzle bodies 40, 42 maximumly project, the nozzle openings 41, 43 are located on the central axis 56. The nozzle opening 43 is positioned about 3 cm forward of the nozzle opening 41. The nozzle openings 41, 43, which are directed in an optimum direction for applying hot water to the parts to be washed, are different in diameter from each other: the nozzle opening 43 is larger in diameter than the nozzle opening 41. This is because the bidet nozzle is longer in length and therefore is subject to larger in pressure losses. Making the nozzle opening 43 larger in diameter than the nozzle opening 41 allows the hot water jetted out of the nozzle openings 41, 43 to be substantially equal in flow rate to each other but makes the washing water jetting out from the nozzle opening 43 smaller in pressure, thereby allowing the female genitalia to be softly washed. Thus, the anus washing nozzle has a large washing water pressure and therefore provides a high washing effect, while the bidet nozzle allows the female genitalia to be washed softly and refreshingly.

In the above-described arrangement, when the user sits on the toilet seat 20 and actuates the operating knob 36, the pump 22 and the solenoid valve 25 are energized. Thereupon, water is sucked in from the water tank 23 through the filter 24 and is introduced into the washing apparatus body 19. The water is further pressurized by the pump 22 to enter the hot-water tank 26 and is heated by a hot-water heater (not shown) to become hot water of an optimum temperature (about 40° C.) and is then delivered to the function changeover valve 28. The user switches over the function changeover valve 28 by the use of the function changeover knob 35 according to the use of either the anus washing nozzle or the bidet nozzle. Accordingly, in the case of washing the anus, the hot water is supplied to the anus washing nozzle 30; in the case of washing the female genitalia, the hot water is supplied to the bidet nozzle 31. The hot water supplied to the nozzle 30 or 31 enters the cylinder 44 or 45 through the water inlet 54 or 55 and applies hydraulic pressure to the nozzle body 40 or 42.

Figure 14:
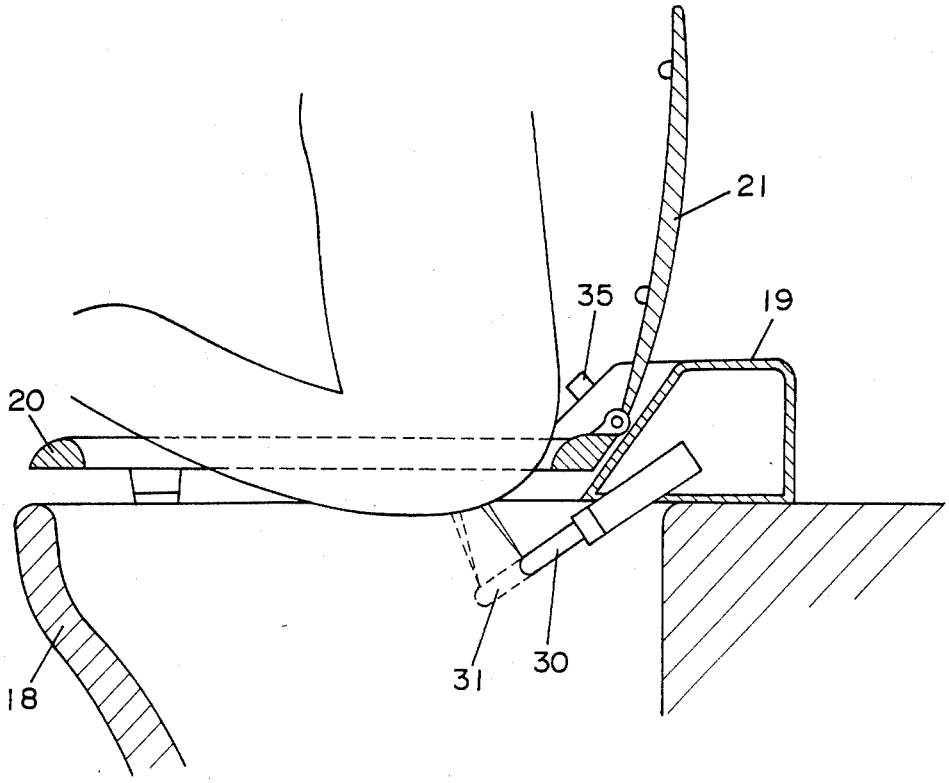
FIG. 14 is a sectional view showing how the sanitary washing apparatus is used for washing.

Thereupon, the nozzle body 40 or 42 moves toward the interior of the toilet bowl 18 against the load applied thereto by the spring 52 or 53. When the nozzle opening 41 or 43 of the nozzle body 40 or 42 reaches the central axis 56 of the toilet bowl 18, the packing 56' or 57 abuts against the cylindrical portion 46 or 47 of the guide portion 39 to stop the projecting motion of the nozzle body 40 or 42. At this time, the hot water passes through the water supply passage 40*b* or 42*b* inside the nozzle body 40 or 42 and jets out from the nozzle opening 41 or 43 toward the anus or female genitalia of the human body for washing. FIG. 14 schematically shows how a person washes using the sanitary washing apparatus. The nozzle opening 41 is directed toward the anal part, while the nozzle opening 43 is directed toward the female genitalia. Both the nozzle openings 41, 43 are arranged so as to be located at the respective positions on the central axis 56 which are most suitable for washing.

The washing water pressure is set to be large for washing the anus but small for washing the female genitalia.

When the anus washing nozzle 30 is first used, the cylinder 44 for the anus washing nozzle 30 is heated, and the heat is transferred to the cylinder 45 for the bidet nozzle 31 thereby preheating the whole of the bidet nozzle 31. Conversely, when the bidet nozzle 31 is first used, the heated cylinder 45 preheats the anus washing nozzle 30. Thus, when the function changeover valve 28 is switched over, hot water of an optimum temperature is instantaneously jetted out of the nozzle to which the user has changed over.

As has been described above, according to this embodiment, when the user first uses one of the nozzles 30 and 31 and then changes over to the other, there is hardly a possibility that hot water may be cooled down by the other nozzle 31 or 30, to which the user has changed over, and may jet out therefrom as cold water, so that it is possible to continuously wash with comfortable hot water. It is frequent practice for, particularly, women to use both the nozzles in one washing operation by changing over the nozzles, one to the other. In such a case, however, the user hardly feels a difference in temperature between the washing water jetted out from one nozzle and that from the other.

Further, since the anus washing nozzle 30 and the bidet nozzle 31 are provided in parallel to each other and the water inlets 54, 55 are positioned close to each other, the hoses 29, 29' connected between the function changeover valve 28 and both the nozzles 30, 31 are substantially equal in length to each other. Accordingly, the response times of the nozzles are substantially equal to each other, so that even when the anus washing nozzle and the bidet nozzle are alternately used, the user can wash without any discomfort.

The filth washed away by a jet of hot water scatters along the central axis 56 of the toilet bowl 18 owing to the shape of the washing unit. According to this embodiment, the washing nozzles 30, 31 are both positioned diagonally with respect to the central axis 56 of the washing apparatus body 19 and the toilet bowl 18. For this reason, the nozzles 30, 31 are hardly exposed to scattering filth and therefore have few failures caused by filth, such as clogging, sliding failure and corrosion.

Since the water inlets 54, 55 are both directed toward the hot-water tank 26 and the function changeover valve 28, the connecting hoses 29, 29' are reduced in length, so that the amount of water remaining in the piping can be minimized. In addition, since the washing nozzles 30, 31, the connecting hoses 29, 29', and the hot-water tank 26 are accommodated in the washing apparatus body 19, the warmth thereof is retained and there is only a small reduction in temperature of hot water when the apparatus is in an inoperative state.

Furthermore, since the anus washing nozzle 30 is positioned closer to the toilet bowl central axis 56 than the bidet nozzle 31, the anus washing nozzle 30 has a shorter length than the bidet nozzle 31 for allowing the nozzle openings 41, 43 of the nozzle bodies 40, 42 to lie along the toilet bowl central axis 56. Accordingly, the bidet nozzle 31 has larger pressure losses; therefore, the washing water jetting out from the bidet nozzle 31 is smaller in pressure than that from the anus washing nozzle 30. Thus, reasonable washing can be effected, and it is possible to obtain such advantageous effects as an excellent feeling while washing and a high washing effect.

The following is a description of still another embodiment of the present invention.

Figure 15:
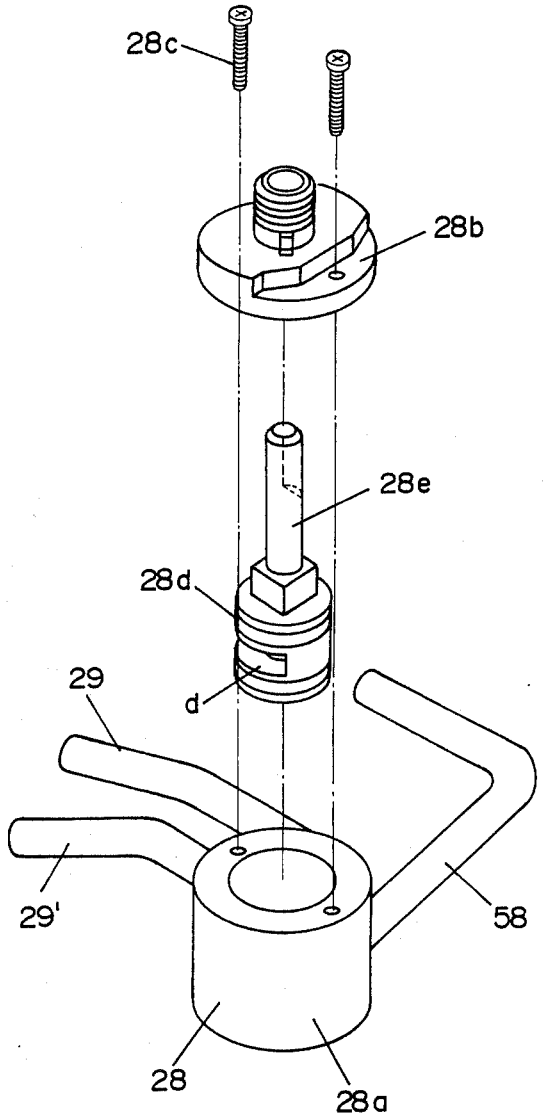
FIG. 15 is an exploded perspective view of an essential part of a function changeover valve of the sanitary washing apparatus.
Figure 16:
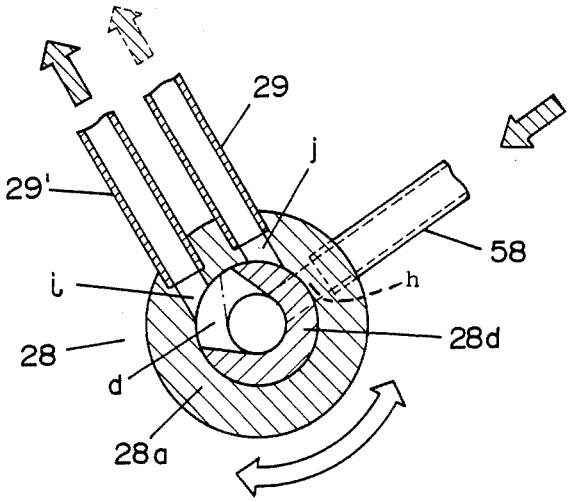
FIG. 16 is a horizontal sectional view of the essential part of the function changeover valve.
Figure 17:
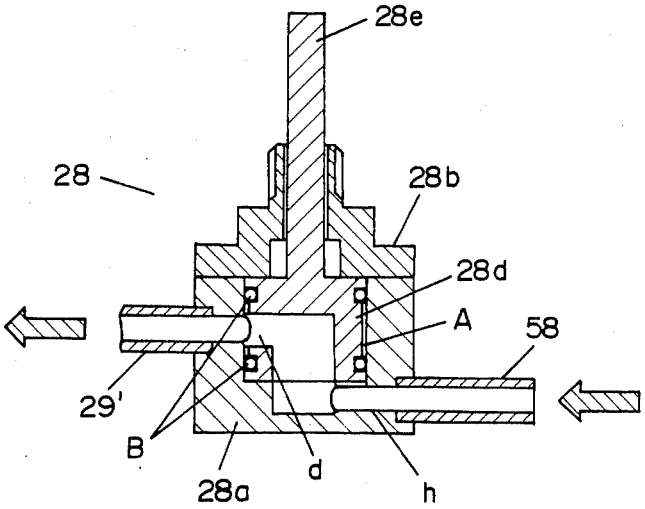
FIG. 17 is a vertical sectional view of the essential part of the function changeover valve.

The function changeover valve 28 shown in FIGS. 15 to 17 is composed of: a cylindrical closed-end casing **28*a* of brass (the reference symbol h denotes a water inlet, and the symbols i, j represent outlets); a cover 28*b* which covers the upper-side opening of the casing 28*a*; screws 28*c* for securing the cover 28*b* to the casing 28*a*; and a valve body 28*d* rotatably accommodated in the casing 28*a*. A shaft 28*e* projects from the upper part of the valve body 28*d*, extending through the cover 28*b*. The function changeover knob 35 is connected to the shaft 28*e***.

Both the cover **28*b* and the valve body 28*d* are formed of Noryl resin. The valve body 28*d*** has the following particular construction.

The valve body **28*d* is formed into a closed-end cylinder shape and has the lower-side opening thereof communicated with a connecting hose 58**.

The valve body **28*d* is further provided in a side wall portion thereof with an opening d which is selectively communicated with the connecting hose 29 or 29'. In addition, a side wall intermediate portion of the valve body 28*d* is formed such that a clearance A is defined between the entire circumference of the intermediate portion and the inner wall of the casing 28*a*. On the other hand, the upper and lower ends of the side wall of the valve body 28*d* are designed such as to come in practically close contact with the inner wall of the casing 28*a*. Packings B are secured through silicone grease to the portions of the upper and lower ends of the valve body 28*d*** closer to the intermediate portion thereof.

More specifically, in this embodiment, when the opening d in the valve body **28*d* is communicated with one of the connecting hoses (e.g., 29' as shown in FIG. 16), a part of the hot water flowing into the connecting hose 29' flows also into the connecting hose 29** through the clearance A, thus forming a subsidiary water path by means of the clearance A.

This subsidiary water path is extremely useful.

The function of the subsidiary water path will be practically described. In the case where a woman first uses the anus washing nozzle 30 and then successively uses the bidet nozzle 31, even when the anus washing nozzle 30 is being used, a small amount of hot water flows also into the bidet nozzle 31 through the subsidiary water path and the connecting hose 29 and drips little by little, thereby allowing the bidet nozzle 31 to rise in temperature little by little.

For this reason, if the user changes over the opening d in the valve body **28*d* to the connecting hose 29 in order to use the bidet nozzle 31 immediately after the use of the anus washing nozzle 30, the hot water flowing into the bidet nozzle 31** will not be cooled down thereby, and it is possible to wash the female genitalia with hot water from the beginning of washing. Thus, washing is extremely comfortable.

Further, in this embodiment, the subsidiary water path is formed by the clearance A. Therefore, additional constituent part is required, so that the production cost can be reduced. In addition, the contact resistance between the casing **28*a* and the valve body 28*d* is decreased in correspondence with a reduction in contact area by the clearance A; hence, the valve body 28*d*** can advantageously be actuated with a relatively light force.

INDUSTRIAL APPLICABILITY

The present invention offers the following advantageous effects:

(1) Since the washing apparatus body is mounted on the toilet bowl, and the hot-water tank, the function changeover valve and at least a part of a plurality of nozzles are disposed inside the washing apparatus body, the length of the water path extending from the hot-water tank to each nozzle is extremely reduced, thereby making it possible to minimize the amount of water retained in the water path after suspension of a washing operation. As a result, there is no possibility that the user may be made to feel uncomfortably by being contacted by a jet of cold water when washing commences. In addition, it is possible to effect a comfortable washing, since there is only a small reduction in temperature of hot water at the beginning of washing and any lowered temperature quickly recovers to a fixed temperature.

(2) According to the embodiments, it is conveniently possible to select one of the three modes, i.e., the anus washing nozzle, the bidet nozzle or both in combination by means of the function changeover valve whether it is before or after the commencement of washing.

(3) According to the embodiments, if the user first uses one of the washing nozzles and then changes over to the other, since the washing nozzle to which the user has changed over has been preheated by the previous washing operation, the user is not chilled by cold water at the beginning of washing after changeover, but can continuously wash with warm water of an optimum temperature.

(4) According to the embodiments, the nozzles are positioned diagonally with respect to the central axis of the toilet bowl. For this reason, the nozzle openings of the anus washing nozzle and the bidet nozzle can project on the toilet bowl central axis; therefore, it is possible to properly apply a jet of hot water to the parts to be washed. In addition, the nozzles are hardly soiled by scattering waste, so that it is possible to prevent failure and contamination of the washing nozzles.

(5) According to the embodiments, both nozzles are positioned close to each other. Therefore, the lengths of the hoses connected to the nozzles can be equalized, and the nozzles are made substantially equal in response time to each other, so that the user can alternately use the nozzles by changing them over from one to the other without feeling any discomfort.

(6) Since the nozzles are provided in the washing apparatus body, the warmth of the hot water can excellently be retained, and the washing nozzles themselves are hardly contaminated.

(7) According to the embodiments, the anus washing nozzle is positioned closer to the toilet bowl central axis than the bidet nozzle. For this reason, the anus washing nozzle is shorter in length than the bidet nozzle and therefore has smaller pressure losses than the bidet nozzle. Accordingly, the washing water jetting out from the anus washing nozzle has a large pressure, while the washing water jetting out from the bidet nozzle has a small pressure. Thus, it is possible to obtain a washing which feels comfortable and is suited to the use of each nozzle, and the washing effect is also increased.

(8) According to the embodiments, even when one of the washing nozzles is being used, the other washing nozzle is supplied with hot water through the subsidiary water path formed in the changeover valve. Therefore, there is no possibility that cold water may be jetted out from the other washing nozzle at the beginning of use of this nozzle (any cold water jetting out therefrom being minimal), so that washing can be made extremely comfortable.

Further, the employment of the above-described construction eliminates the need for any means for heating the other nozzle, which is not being used. Accordingly, as compared with the sanitary washing apparatus having heating means, the apparatus of the invention is extremely advantageous in that it is possible to reduce its production cost and size.

What is claimed is:

1. A sanitary washing apparatus comprising:

a toilet bowl having a central axis;

a washing apparatus body installed on said toilet bowl;

a hot-water tank provided in said washing apparatus body and supplied with water from outside said washing apparatus body by a feed water means;

a function changeover valve provided in said washing apparatus body and connected to said hot-water tank a plurality of nozzles connected to said function changeover valve, at least a part of said nozzles being provided within said washing apparatus body; and a vacuum releasing valve provided in a water path between said hot-water tank and said function changeover valve for discharging water in the water path downstream therefrom after use of the appartus, wherein after use of the apparatus said functional changeover valve remains in its last operative state and the vacuum is released, whereby no water remain in the downstream water path in a standby state.

2. A sanitary washing apparatus according to claim 1, wherein the number of said nozzles is two, one of which is employed as an anus washing nozzle, and the other of which is employed as a bidet nozzle, said two nozzles being located in substantially the same horizontal plane and disposed adjacent each other and at an acute angle with respect to the central axis of said toilet bowl, said anus washing nozzle being provided closer to the central axis of said toilet bowl than said bidet nozzle.

3. A sanitary washing apparatus according to claim 1, wherein said function changeover valve includes a valve casing having one water inlet and a plurality of outlets, and a valve body rotatably provided within said valve casing, said valve body having therein a water supply passage, and wherein one of said outlets is selected by turning said valve body, and a subsidiary water path to the other outlets is formed by a clearance defined between said valve casing and said valve body.

4. A sanitary washing apparatus comprising:

a toilet bowl having a central axis;

a washing apparatus body installed on said toilet bowl;

a hot-water tank provided in said washing apparatus body and supplied with water from outside said washing apparatus body by a feed water means;

a function changeover valve provided in said washing apparatus body and connected to said hot-water tank;

an anus washing nozzle and a bidet nozzle, said nozzles connected to said function changeover valve and being located in substantially the same horizontal plane and disposed adjacent each other and at an acute angle with respect to the central axis of said toilet bowl, said anus washing nozzle being provided closer to the central axis of said toilet bowl than said bidet nozzle, at least a part of each said nozzle being provided within said washing apparatus body and the area of a hot-water jetting nozzle opening of said bidet nozzle is made larger than the area of a hot water jetting nozzle opening of said anus washing nozzle; and a vacuum releasing valve provided in a water path between said hot-water tank and said function changeover valve for discharging water in the water path downstream therefrom after use of the apparatus, wherein after use of the apparatus said functional changeover valve remains in its last operative state and the vacuum is released, whereby no water remains in the downstream water path in a standby state.

5. A sanitary washing apparatus comprising;

a toilet bowl having a central axis;

a washing apparatus body installed on said toilet bowl;

a hot-water tank provided in said washing apparatus body and supplied with water from outside said washing apparatus body by feed water means;

a function changeover valve provided in said washing apparatus body and connected to said hot-water tank; and a plurality of nozzles connected to said function changeover valve, at least a part of said nozzles being provided within said washing apparatus body, wherein said function changeover valve is arranged such that when the water path is changed over to one of said nozzles, a subsidiary water path is formed for the other nozzles.

6. A sanitary washing apparatus according to claim 5, wherein the number of said nozzles is two, one of which is employed as an anus washing nozzle, and the other of which is employed as a bidet nozzle.

7. A sanitary washing apparatus according to claim 5, wherein said function changeover valve includes a valve casing having one water inlet and a plurality of outlets, and a valve body having therein a water supply passage, and wherein one of said outlets is selected by turning said valve body, and a subsidiary water path to the other outlets is formed by a clearance defined between said valve casing and said valve body.

8. A sanitary washing apparatus according to claim 5, further comprising a vacuum releasing valve provided in a water path between said hot-water tank and said function changeover valve.

9. A sanitary washing apparatus according to claim 6, wherein said two nozzles are located in substantially the same horizontal plane and disposed adjacent each other and at an acute angle with respect to the central axis of said toilet bowl, said anus washing nozzle being provided closer to the central axis of said toilet bowl than said bidet nozzle.

10. A sanitary washing apparatus according to claim 9, wherein the area of a hot-water jetting nozzle opening of said bidet nozzle is made larger than the area of a hot-water jetting nozzle opening of said anus washing nozzle.

* * * * *